US007794312B2

(12) United States Patent
Zimmer et al.

(10) Patent No.: US 7,794,312 B2
(45) Date of Patent: Sep. 14, 2010

(54) ENCLOSURE COVER AND METHOD FOR MAKING AN ENCLOSURE COVER

(75) Inventors: Donald N. Zimmer, Marshalltown, IA (US); John Nhu Tran, The Colony, TX (US)

(73) Assignee: Lennox Industries, Inc., Richardson, TX (US)

( * ) Notice: Subject to any disclaimer, the term of this patent is extended or adjusted under 35 U.S.C. 154(b) by 1176 days.

(21) Appl. No.: 11/245,633

(22) Filed: Oct. 7, 2005

(65) Prior Publication Data

US 2007/0089897 A1 Apr. 26, 2007

(51) Int. Cl.
*F24F 7/00* (2006.01)

(52) U.S. Cl. ..... 454/280; 454/279; 454/254

(58) Field of Classification Search ..... 454/254
See application file for complete search history.

(56) References Cited

U.S. PATENT DOCUMENTS 2,366,224 A * 1/1945 Warp ..... 454/280

3,103,158 A * 9/1963 Noll ..... 49/2

* cited by examiner

*Primary Examiner*—Steve McAllister
*Assistant Examiner*—Helena Kosanovic

(57) ABSTRACT

A covering apparatus for an enclosure presenting a ventilating barrier curved with respect to a barrier axis includes a segmented panel member having a plurality of louvered areas. Respective adjacent louvered areas of the plurality of louvered areas are separated by a respective bend structure. Each respective bend structure has a first section departing in a first direction from a first bend axis and a second section departing in a second direction from a second bend axis. The first and second bend axes are generally parallel with the barrier axis. The first direction is generally away from the second bend axis. The second direction is generally away from the first bend axis. The bend structure further has a third section extending from the first and second bend axes to a third bend axis. The third bend axis is non-coplanar with the first and second bend axes.

20 Claims, 2 Drawing Sheets

ENCLOSURE COVER AND METHOD FOR MAKING AN ENCLOSURE COVER

BACKGROUND OF THE INVENTION

The present invention is directed to equipment enclosure structures, and especially to equipment enclosure structures providing ventilation to enclosed equipment. By way of example and not by way of limitation, the present invention is particularly useful for enclosing HVAC (Heating, Ventilating and Air Conditioning) equipment.

It is sometimes desired to enclose equipment in a cabinet or similar enclosure having a curved panel, such as a curved exterior panel. By way of example and not by way of limitation, a cabinet may enclose HVAC equipment with a louvered or otherwise ventilating configuration in a curved installation orientation. There are problems with curving planar panels to conform with an installed curved orientation. Problems may include, for example, buckling or other uncontrollable deformation of the panel during bending. The problems may be exacerbated when the panel to be formed into a curved installation orientation includes louvers. Louvers may be distorted during bending in addition to causing deformation of the panel.

There is a need for a barrier for an enclosure and a method for making the enclosure that may be formed from a planar configuration to a curved installation orientation without significant deformation of the barrier.

There is a need for a barrier for an enclosure and a method for making the enclosure that may be formed from a planar configuration to a curved installation orientation including louvers in the barrier without significant deformation of the barrier or the louvers.

SUMMARY OF THE INVENTION

A covering apparatus for an enclosure presenting a ventilating barrier curved with respect to a barrier axis includes a segmented panel member having a plurality of louvered areas. Respective adjacent louvered areas of the plurality of louvered areas are separated by a respective bend structure. Each respective bend structure has a first section departing in a first direction from a first bend axis and a second section departing in a second direction from a second bend axis. The first and second bend axes are generally parallel with the barrier axis. The first direction is generally away from the second bend axis. The second direction is generally away from the first bend axis. The bend structure further has a third section extending from the first and second bend axes to a third bend axis. The third bend axis is non-coplanar with the first and second bend axes.

A method for covering an enclosure with a ventilating barrier presenting a predetermined curve with respect to a barrier axis includes the steps of: (a) Providing a segmented panel member having a plurality of louvered areas. (b) Providing a respective bend structure separating respective adjacent louvered areas of the plurality of louvered areas. Each respective bend structure has a first section departing in a first direction from a first bend axis and a second section departing in a second direction from a second bend axis. The first and second bend axes are generally parallel with the barrier axis. The first direction is generally away from the second bend axis. The second direction is generally away from the first bend axis. The bend structure further has a third section extending from the first and second bend axes to a third bend axis. The third bend axis is non-coplanar with the first and second bend axes. (c) Manipulating the segmented panel member to conform substantially to the predetermined curve.

It is, therefore, an object of the present invention to provide an enclosure and a method for making the enclosure that may be formed from a planar configuration to a curved installation orientation without significant deformation of the barrier.

It is a further object of the present invention to provide an enclosure and a method for making the enclosure that may be formed from a planar configuration to a curved installation orientation including louvers in the barrier without significant deformation of the barrier or the louvers.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
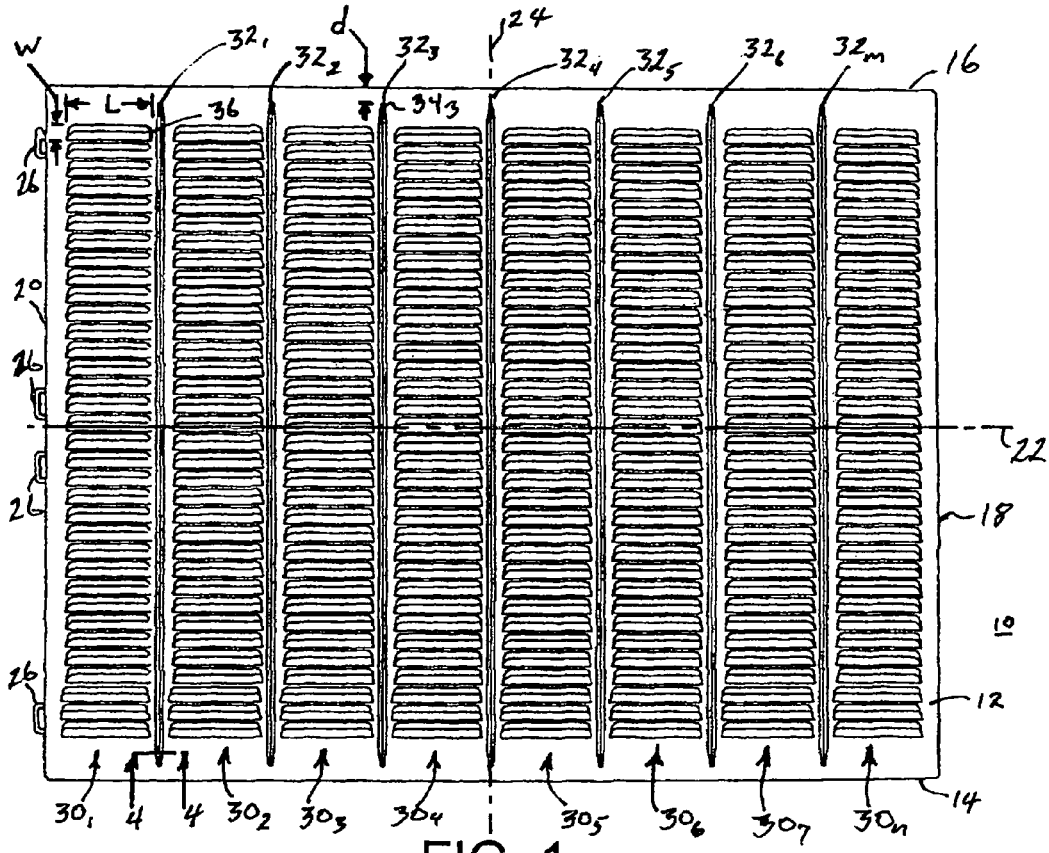
FIG. 1 is a front plan view of the enclosure of the present invention.
Figure 2:
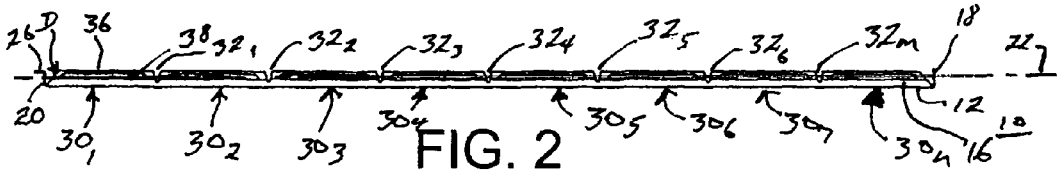
FIG. 2 is an end view of the enclosure illustrated in FIG. 1 in a substantially flat orientation.
Figure 3:
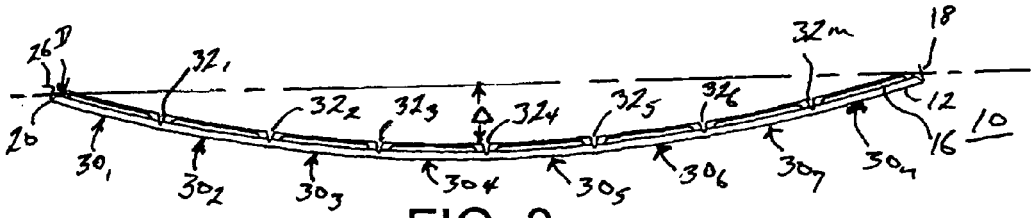
FIG. 3 is an end view of the enclosure illustrated in FIG. 1 in a curved orientation.

FIG. 1 is a front plan view of the enclosure of the present invention. FIG. 2 is an end view of the enclosure illustrated in FIG. 1 in a substantially flat orientation. FIG. 3 is an end view of the enclosure illustrated in FIG. 1 in a curved orientation. Regarding FIGS. 1-3, a cover apparatus 10 is configured of a substantially planar generally rectangular panel 12 having opposing sides 14, 16 and opposing sides 18, 20. Panel 12 is substantially symmetrical with respect to a first axis 22 and with a second axis 24. Axis 24 is substantially perpendicular with axis 22. Mounting structures, such as tabs 26, may be provided for mounting panel 12 to cover an enclosure (not shown in FIGS. 1-3).

Panel 12 is arranged having a plurality of areas $\mathbf{30}_1$, $\mathbf{30}_2$, $\mathbf{30}_3$, $\mathbf{30}_4$, $\mathbf{30}_5$, $\mathbf{30}_6$, $\mathbf{30}_7$, $\mathbf{30}_n$ separated and defined by demarcation structures $\mathbf{32}_1$, $\mathbf{32}_2$, $\mathbf{32}_3$, $\mathbf{32}_4$, $\mathbf{32}_5$, $\mathbf{32}_6$, $\mathbf{32}_m$. The indicators "n" and "m" are employed to signify that there can be any number of areas separated by any number of demarcation structures in panel 12. The inclusion of eight areas $\mathbf{30}_1$, $\mathbf{30}_2$, $\mathbf{30}_3$, $\mathbf{30}_4$, $\mathbf{30}_5$, $\mathbf{30}_6$, $\mathbf{30}_7$, $\mathbf{30}_n$ and seven demarcation structures $\mathbf{32}_1$, $\mathbf{32}_2$, $\mathbf{32}_3$, $\mathbf{32}_4$, $\mathbf{32}_5$, $\mathbf{32}_6$, $\mathbf{32}_m$ in FIGS. 1-3 is illustrative only and does not constitute any limitation regarding the number of areas and demarcation structures that may be included in the apparatus of the present invention. In the preferred embodiment of the present invention, m=n−1.

Selected areas $\mathbf{30}_n$ include a plurality of louver structures 36; in order to simplify the drawings, only a representative louver structure 36 in area $\mathbf{30}_1$ will be described in detail. Louver structures in other areas $\mathbf{30}_2$, $\mathbf{30}_3$, $\mathbf{30}_4$, $\mathbf{30}_5$, $\mathbf{30}_6$, $\mathbf{30}_7$, $\mathbf{30}_n$ are preferably substantially similar with louver structures 36 located in area $\mathbf{30}_1$. Louver structure 36 is formed having a length L along an axis substantially parallel with axis 22 and a width W substantially parallel with axis 24. Louver structure 36 extends a depth D away from panel 12, thereby establishing an aperture 38 through panel 12. Preferably, all louver structures 36 extend depth D from panel 12 on the same side of panel 12. Aperture 38 provides a via through panel 12 permitting an exchange of air between equipment within an enclosure that includes panel 12 and an ambient space.

Panel 12 is configured as a segmented panel 12 having a plurality of louvered areas $\mathbf{30}_n$ separated by respective demarcation or bend structures $\mathbf{32}_m$. Respective bend structures $\mathbf{32}_m$ may each be configured to taper to a termination locus $\mathbf{34}_m$ as representatively indicated at a termination locus $\mathbf{34}_3$ in FIG. 1. Termination locus $\mathbf{34}_3$ establishes an end point for bend structure $\mathbf{32}_3$ a distance d from side 16 to avoid wrinkling or buckling of panel 12 at side 16 when panel 12 is flexed or bent. Termination locus $\mathbf{34}_3$ is further described in connection with FIG. 5. In order to simplify this description of the present invention, only one representative termination locus $\mathbf{34}_3$ is described here and in connection with FIG. 5. Each respective bend structure $\mathbf{32}_m$ preferably has substantially similar termination loci at each end, adjacent each of sides 14, 16.

When panel 12 is installed in an enclosure (not shown in FIGS. 1-3) panel 12 is manipulated to conform substantially to a predetermined installation curve established by the enclosure with which panel 12 is connected during installation. A representative such predetermined curve is presented in FIG. 3. In FIG. 3, panel 12 has flexed or bowed to establish a deflection distance Δ from axis 22. Of importance is the lack of buckling or other deformation of sides 14, 16 and within each of areas $\mathbf{30}_n$. This result is achieved because of the presence of demarcation or bend structures $\mathbf{32}_m$ between adjacent areas $\mathbf{30}_n$. Respective bend structures $\mathbf{32}_m$ effect any bending required of panel 12 to conform with the desired predetermined installation curve. The final installed orientation of panel 12 is a segmented approximation of the predetermined installation curve; the curve is approximated by the plurality of straight areas $\mathbf{30}_n$ between bend structures $\mathbf{32}_m$. All bending is effected at respective bend structures $\mathbf{32}_m$, thereby relieving any forces that may otherwise have acted upon respective areas $\mathbf{30}_n$ to deform respective sections $\mathbf{30}_n$.

Figure 4:
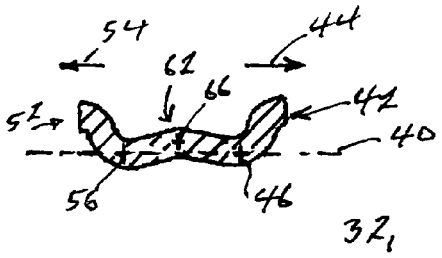
FIG. 4 is a section view of a demarcation bend structure taken along section 4-4 in FIG. 1.

FIG. 4 is a section view of a demarcation bend structure taken along section 4-4 in FIG. 1. In FIG. 4, a representative demarcation or bend structure $\mathbf{32}_1$ is oriented generally on one side of a plane 40. Plane 40 is preferably parallel with axis 22 when panel 12 is in a substantially planar (i.e., unflexed) orientation (best seen in FIG. 1-2), and may be substantially contain axis 22 when panel 12 is in an unflexed orientation. Bend structure $\mathbf{32}_1$ is preferably substantially similar with each respective bend structure $\mathbf{32}_m$.

Bend structure $\mathbf{32}_1$ includes a first section 42 departing generally in a first direction 44 from a first axial bend locus 46 and a second section 52 departing generally in a second direction 54 from a second axial bend locus 56. First axial bend locus 46 and second axial bend locus 56 are generally parallel with one of axis 22 and axis 24 (FIGS. 1-3). First direction 44 is generally away from second axial bend locus 56. Second direction 54 is generally away from first axial bend locus 46. Bend structure $\mathbf{32}_1$ further includes a third section 62. Third section 62 extends from first axial bend locus 46 and from second axial bend locus 56 to a third axial bend locus 66. Third axial bend locus 66 is not coplanar with first axial bend locus 46 and second axial bend locus 56.

Figure 5:
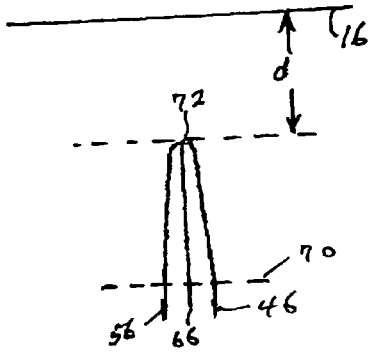
FIG. 5 is an enlarged detail view of a termination of a demarcation bend structure.

FIG. 5 is an enlarged detail view of a termination of a demarcation bend structure. In FIG. 5, a representative termination locus $\mathbf{34}_3$ terminates axial bend loci 46, 56, 66. Termination locus $\mathbf{34}_3$ is preferably substantially similar with termination loci at each end of each respective bend structure $\mathbf{32}_m$. Axial bend loci 46, 56, 66 are substantially parallel, as described in connection with FIG. 4, until a deviation locus 70 is reached. At deviation locus 70, axial bend loci 46, 56 begin to converge with axial bend locus 66. Convergence of axial bend loci 46, 56, 66 is substantially completed at an end locus 72. End locus 72 is a generally localized-area locus, approximating a point locus, situated distance d from side 16 of panel 12 (see FIG. 1) to avoid wrinkling or buckling panel 12 at side 16.

Figure 6:
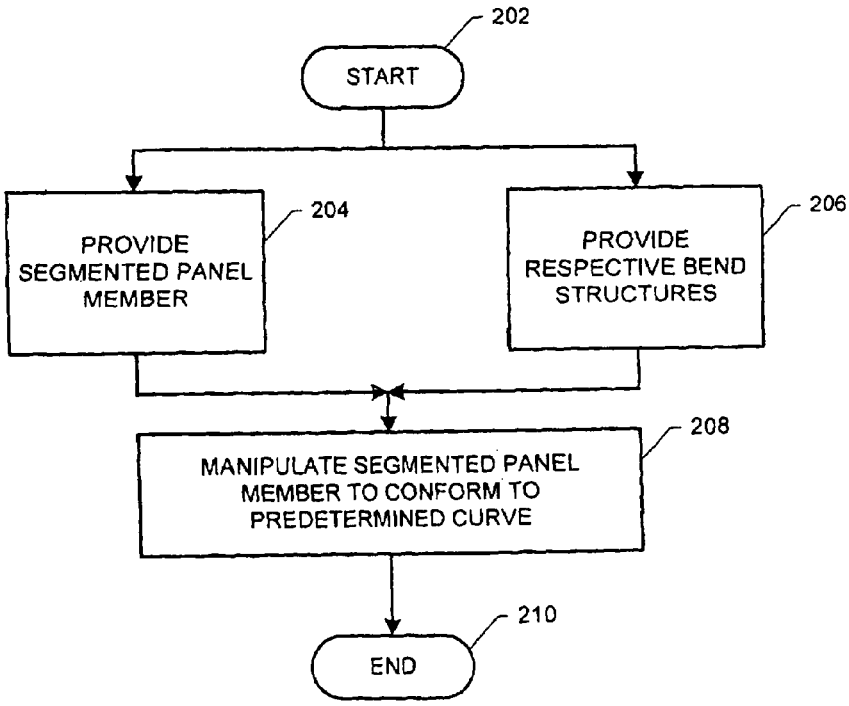
FIG. 6 is a flow chart illustrating the method of the present invention.

FIG. 6 is a flow chart illustrating the method of the present invention. In FIG. 6, a method 200 for covering an enclosure with a ventilating barrier presenting a predetermined curve with respect to a barrier axis begins at a START locus 202. Method 200 continues with, in no particular order: (1) Providing a segmented panel member having a plurality of louvered areas, as indicated by a block 204; and (2) providing a respective bend structure separating respective adjacent louvered areas of the plurality of louvered areas, as indicated by a block 204. Each respective bend structure has a first section departing in a first direction from a first bend axis and a second section departing in a second direction from a second bend axis. The first and second bend axes are generally parallel with the barrier axis. The first direction is generally away from the second bend axis. The second direction is generally away from the first bend axis. The bend structure further has a third section extending from the first and second bend axes to a third bend axis. The third bend axis is non-coplanar with the first and second bend axes. Method 200 continues by manipulating the segmented panel member to conform substantially to the predetermined curve, as indicated by a block 208. Method 200 terminates at an END locus 210.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. An apparatus for covering an equipment enclosure; the apparatus comprising: a panel member having substantial symmetry about a first axis a second axis substantially perpendicular with said first axis; said panel member having a plurality of areas defined by at least one demarcation structure; said at least one demarcation structure having a first section located generally on a first side of said panel and departing in a first direction from a first axial bend locus and a second section located generally on said first side of said panel departing in a second direction from a second axial bend locus; said first and second axial bend loci being generally parallel with one of said first axis and said second axis; said first direction being generally away from said second axial bend locus; said second direction being generally away from said first axial bend locus; said demarcation structure having a third section extending from said first and second axial bend loci to a third axial bend locus such that a cross section taken perpendicular to the axial bend loci axes of said demarcation structure generally forms a W shape; said third axial bend locus being non-coplanar with said first and second axial bend loci; said demarcation structure further having at least one termination locus that establishes an end point for said demarcation structure wherein said first axial bend locus, said second axial bend locus and said third axial bend locus each terminate.

2. An apparatus for covering an equipment enclosure as recited in claim 1 wherein at least one selected area of said plurality of areas includes a plurality of louver structures;

said plurality of louver structures being arrayed along an axis generally parallel with said third axial bend locus of a respective said demarcation structure adjacent to said respective area.

3. An apparatus for covering an equipment enclosure as recited in claim 2 wherein each respective louver structure of said plurality of louver structures establishes an aperture having a length and a width; said length being oriented generally perpendicular with said third axial bend locus of said respective demarcation structure.

4. An apparatus for covering an equipment enclosure as recited in claim 1 wherein said plurality of areas is n areas and said at least one demarcation structure is n−1 demarcation structures.

5. An apparatus for covering an equipment enclosure as recited in claim 4 wherein at least one selected area of said plurality of areas includes a plurality of louver structures;

said plurality of louver structures being arrayed along an axis generally parallel with said third axial bend locus of a respective said demarcation structure adjacent to said respective area.

6. An apparatus for covering an equipment enclosure as recited in claim 1 wherein said panel member extends along the longitudinal axis of said demarcation structure beyond said termination loci of said demarcation structure.

7. A covering apparatus for an enclosure presenting a ventilating barrier curved with respect to a barrier axis; the apparatus comprising: a segmented panel member having a plurality of louvered areas; respective adjacent louvered areas of said plurality of louvered areas being separated by a respective bend structure; each said respective bend structure having a first section departing in a first direction from a first bend axis and a second section departing in a second direction from a second bend axis; said first and second bend axes being generally parallel with said barrier axis; said first direction being generally away from said second bend axis; said second direction being generally away from said first bend axis; said bend structure further having a third section extending from said first and second bend axes to a third bend axis; said respective bend structure having a general W shaped cross section taken perpendicularly across said bend axes; said third bend axis being non-coplanar with said first and second bend axes; wherein said bend structure tapers to a termination locus located at each end of said bend structure.

8. A covering apparatus for an enclosure presenting a ventilating bather curved with respect to a barrier axis as recited in claim 7 wherein each respective said louvered area of said plurality of louvered areas includes a plurality of louver structures; each respective louver structure of said plurality of louver structures establishes an aperture having a length and a width; said length being oriented generally perpendicular with said barrier axis.

9. A covering apparatus for an enclosure presenting a ventilating barrier curved with respect to a barrier axis as recited in claim 7 wherein said plurality of louvered areas is n louvered areas.

10. A covering apparatus for an enclosure presenting a ventilating barrier curved with respect to a barrier axis as recited in claim 9 wherein the apparatus includes n−1 said respective bend structures.

11. A covering apparatus for an enclosure presenting a ventilating barrier curved with respect to a barrier axis as recited in claim 8 wherein said plurality of louvered areas is n louvered areas.

12. A covering apparatus for an enclosure presenting a ventilating barrier curved with respect to a barrier axis as recited in claim 7 wherein said termination locus is situated a non-zero distance from an edge running perpendicular to said bend axes.

13. A method for covering an enclosure with a ventilating barrier presenting a predetermined curve with respect to a barrier axis; the method comprising the steps of:

(a) In no particular order:

(1) providing a segmented panel member having a plurality of louvered areas; and (2) providing a respective bend structure separating respective adjacent louvered areas of said plurality of louvered areas; each said respective bend structure having a first section departing in a first direction from a first bend axis and a second section departing in a second direction from a second bend axis; said first and second bend axes being generally parallel with said barrier axis; said first direction being generally away from said second bend axis; said second direction being generally away from said first bend axis; said bend structure further having a third section extending from said first and second bend axes to a third bend axis; said respective bend structure having a general W shaped cross section taken perpendicularly across said bend axes; said third bend axis being non-coplanar with said first and second bend axes wherein said bend structure tapers to a termination locus located at each end of said bend structure; and (b) manipulating said segmented panel member to conform substantially to said predetermined curve.

14. A method for covering an enclosure with a ventilating barrier presenting a predetermined curve with respect to a barrier axis as recited in claim 13 wherein each respective said louvered area of said plurality of louvered areas includes a plurality of louver structures; each respective louver structure of said plurality of louver structures establishes an aperture having a length and a width; said length being oriented generally perpendicular with said barrier axis.

15. A method for covering an enclosure with a ventilating barrier presenting a predetermined curve with respect to a barrier axis as recited in claim 13 wherein said plurality of louvered areas is n louvered areas.

16. A method for covering an enclosure with a ventilating barrier presenting a predetermined curve with respect to a barrier axis as recited in claim 13 wherein said termination locus is situated a non-zero distance from an edge running perpendicular to said bend axes.

17. A method for covering an enclosure with a ventilating barrier presenting a predetermined curve with respect to a barrier axis as recited in claim 14 wherein said plurality of louvered areas is n louvered areas.

18. A method for covering an enclosure with a ventilating barrier presenting a predetermined curve with respect to a barrier axis as recited in claim 17 wherein the apparatus includes n−1 said respective bend structures.

19. A ventilating barrier for an enclosure; the barrier having a predetermined curved orientation about a barrier axis in an installed orientation; the barrier comprising: a segmented panel member having a plurality of louvered areas; respective adjacent louvered areas of said plurality of louvered areas being separated by a respective bend structure; each said respective bend structure having a plurality of sections connecting a plurality of bend axes and each said respective bend structure tapers to a termination locus located at each end thereof; said respective bend structure having a general W shaped cross section taken perpendicularly across said bend axes; each respective bend axis of said plurality of bend axes being substantially parallel with said barrier axis; said plurality of sections cooperating to substantially establish said predetermined curved orientation in response to a bending force urging said panel member toward said installed orientation.

20. An apparatus as recited in claim 19 wherein said termination locus is situated a non-zero distance from an edge running perpendicular to said bend axes.

* * * * *